US009395061B2

(12) United States Patent
Yang

(10) Patent No.: US 9,395,061 B2
(45) Date of Patent: Jul. 19, 2016

(54) CANDLE-LIKE LIGHTING DEVICE WITH ROTATABLE SHELL

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 19 days.

(21) Appl. No.: 14/318,701

(22) Filed: Jun. 30, 2014

(65) Prior Publication Data

US 2015/0377449 A1 Dec. 31, 2015

(51) Int. Cl.

| | |
|---|---|
| ***F21S 8/00*** | (2006.01) |
| ***F21V 21/00*** | (2006.01) |
| ***F21V 35/00*** | (2006.01) |
| ***F21V 1/10*** | (2006.01) |
| ***F21S 6/00*** | (2006.01) |
| *F21W 101/02* | (2006.01) |

(52) U.S. Cl.
CPC . *F21V 1/10* (2013.01); *F21S 6/001* (2013.01); *F21W 2101/02* (2013.01)

(58) Field of Classification Search
CPC ..... F21S 6/001; G09F 17/00; G09F 19/02; G09F 19/12; F21V 1/10; F21W 2101/02
USPC ..... 362/565, 555, 351, 361
See application file for complete search history.

(56) References Cited

U.S. PATENT DOCUMENTS

| | | | | |
|---|---|---|---|---|
| 5,685,097 | A * | 11/1997 | Marinov | 40/431 |
| 6,584,713 | B2 * | 7/2003 | Huang | 40/431 |
| 7,003,906 | B1 * | 2/2006 | Yang | 40/430 |
| 7,473,002 | B1 * | 1/2009 | Chen | 362/35 |
| 2008/0117633 | A1 * | 5/2008 | Li | 362/253 |
| 2008/0151534 | A1 * | 6/2008 | Lin | 362/191 |
| 2010/0085737 | A1 * | 4/2010 | Yang | 362/101 |
| 2014/0307428 | A1 * | 10/2014 | Ng | F21L 27/00 362/194 |

* cited by examiner

*Primary Examiner* — Donald Raleigh
(74) *Attorney, Agent, or Firm* — Leong C. Lei

(57) ABSTRACT

A candle-like lighting device includes a candle shell, a stand and a reflector. The candle shell is positioned above the stand at which the reflector is secured and extends inside the candle shell. A control circuit, an illuminator as surrounded by the reflector and a rotating unit are provided within the stand. The candle shell, spinning as driven y the rotating unit, is provided with a void area. Thereby a light from the illuminator transmits through the void area of the reflector for projecting the shape of the void area on a surface of the spinning candle shell in order to achieve the dynamic visual effect.

6 Claims, 6 Drawing Sheets

CANDLE-LIKE LIGHTING DEVICE WITH ROTATABLE SHELL

TECHNICAL FIELD OF THE INVENTION

The present invention is related to an electric candle, particularly a candle-like lighting device to achieve a dynamic visual effect.

DESCRIPTION OF THE PRIOR ART

It is a fact that a candle is the most common illuminating means not only to provide a simple illumination but also to produce a specific mood and ambience particularly for various situations in life. Thus the applications of candles are frequent because of the demands on illumination and beauty sensation. In recent years the consciousness of environmental protection becomes a worldwide emphasis that an electric candle is gradually focused because of the ability to be repeatedly used to achieve an effectiveness of candle lightening without pollution.

Currently the electric candle available in the market for producing a specific ambience and mood is provided with a shell in a candle form by injection molding and subsequent manufacturing processes like engraving, transfer printing or electrical plating onto both inner and outer circumference of the shell inside which an illuminator is provided. Thereby the textures on both inner and outer circumference created by the manufacturing processes are so utilized in order to achieve a pleasing visual effect. However the current electric candle only can demonstrate a visual effect in a static monotone without any dynamic changes in the visual effect. This is the deficiency of the current electric candle.

SUMMARY OF THE INVENTION

An objective of the present invention is to resolve the deficiency, without dynamic visual effect, of the electric candle of the prior art by enhancing the visual effect at different levels of sensation.

Therefore the present invention is to provide a candle-like lighting device primarily includes a candle shell in a hollow form of a transparent material with a downward opening and a pre-determined texture on a surface of the candle shell.

A stand positioned underneath the candle shell with a control circuit, at least an illuminator, as electrically connected with the control circuit, and a rotating unit provided within the stand. The illuminator is surrounded by the candle shell while the rotating unit consists of a gear set as connected with a power unit. The candle shell is positioned on the gear set and thus spins as driven thereby.

A reflector in non-transparent form with a bottom secured to the stand and a top extended inside the candle shell surrounding the illuminator. A portion of the reflector is configured with a void area.

Thereby, when the power unit is at conductive state, the gear set inside the stand rotates and drives the candle shell to spin that a light from the illuminator transmits through the void area of the reflector for projecting the shape of the void area on a surface of the spinning candle shell in order to achieve a dynamic visual effect.

DETAILED DESCRIPTION OF THE PREFERRED EMBODIMENTS

Figure 1:
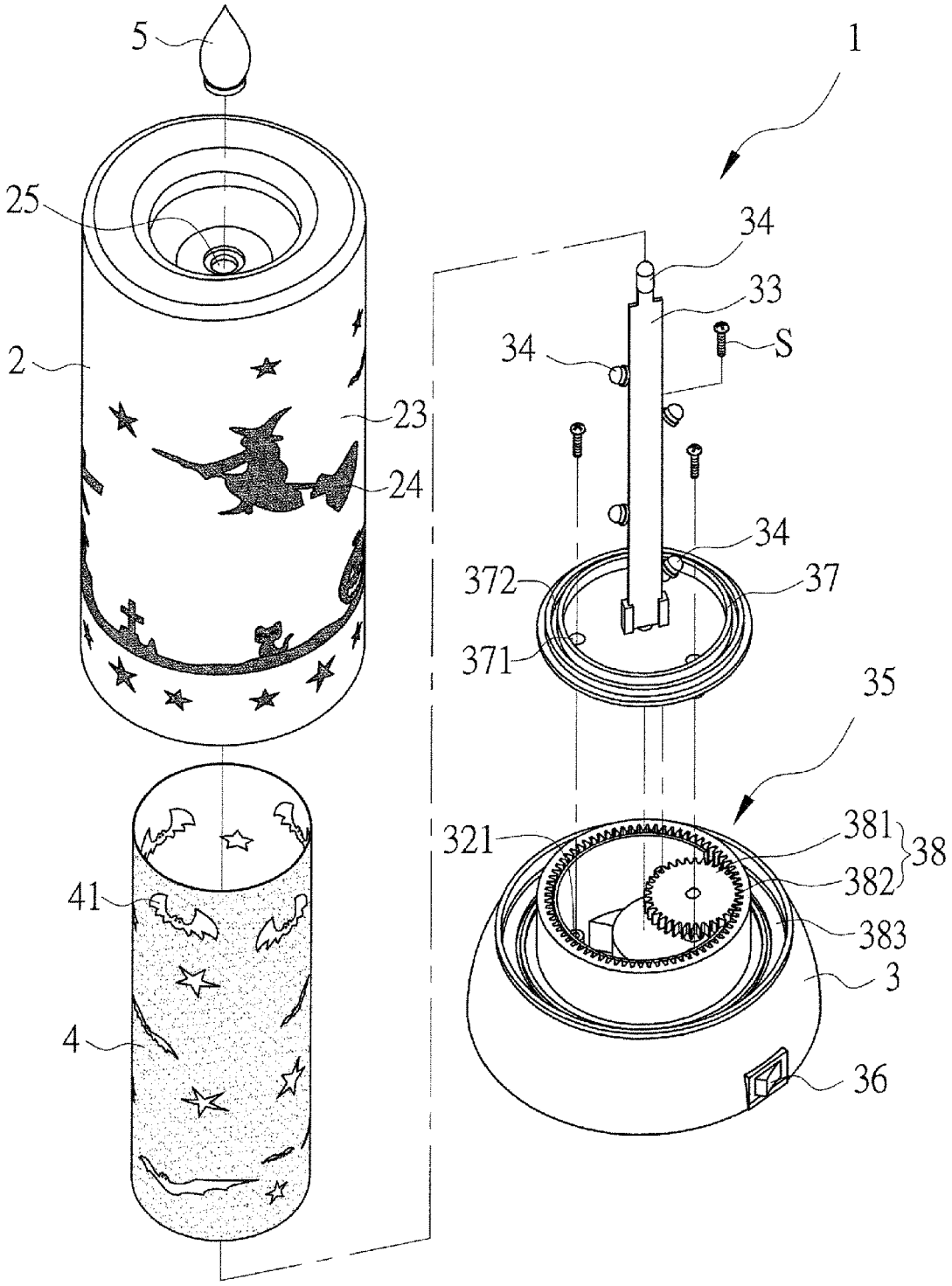
FIG. 1 is a disassembly diagram illustrating a preferred embodiment of the present invention.
Figure 2:
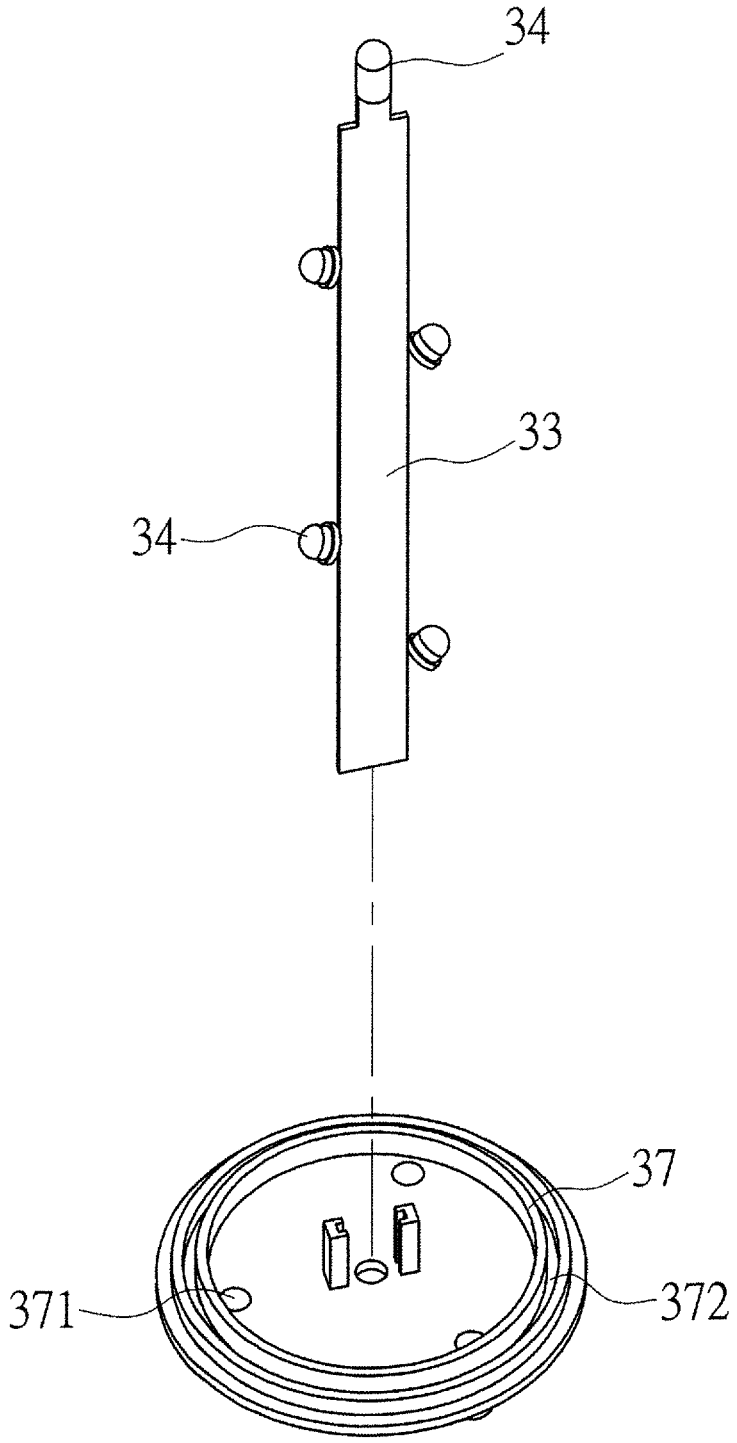
FIG. 2 is a localized disassembly diagram illustrating the preferred embodiment of the present invention.

Please refer FIG. 1 to FIG. 6 illustrating a disassembly diagram, an assembly diagram and a cross-section diagram of a preferred embodiment of a candle-like lighting device of the present invention. The candle-like lighting device (1) primarily consists of a candle shell (2), a stand (3) and a reflector (4).

The candle shell (2) is made of a transparent material in a hollow shape like a tube and provided with a downward opening (21). The candle shell (2) is configured with an inner surface (22) and an outer surface (23) that in this preferred embodiment the outer surface (23) is provided with a predetermined texture (24), which can be positioned at the inner surface (22) as well and is formed by one of the manufacturing processes such as engraving, transfer-printing or electrical plating. An aperture (25) is configured at a top of the candle shell (2) and physically connected with an internal space of the candle shell (2). A bulb (5) is further provided at the aperture (25) that the bulb (5) is in a shape of candle flame in order to mimic a real candle appearance.

The stand (3) consists of a casing (31) and a bottom lid (32) that a control circuit (33), a multiply illuminators (34), which are electrically connected with the control circuit (33), a rotating unit (35) and a switch (36) are provided within the stand (3). Each of the multiply illuminators (34) is positioned at the control circuit (33) in a staggered pattern with one of the multiply illuminators (34) extending inside the bulb (5) that the control circuit (33) is utilized to control both flashing frequency and lightening color of the multiply illuminators (34). A bottom of the control circuit (33) is provided with a support element (37) on which a plurality of holes (371) and a groove (372) are configured that the bottom lid (32) of the stand (3) is provided with a plurality of studs (321) according to the plurality of holes (371) in order to secure the support element (37) onto the stand (3). Further the stand (3) is circularly provided with a bridge part (322) from the bottom lid (32) upward.

Figure 3:
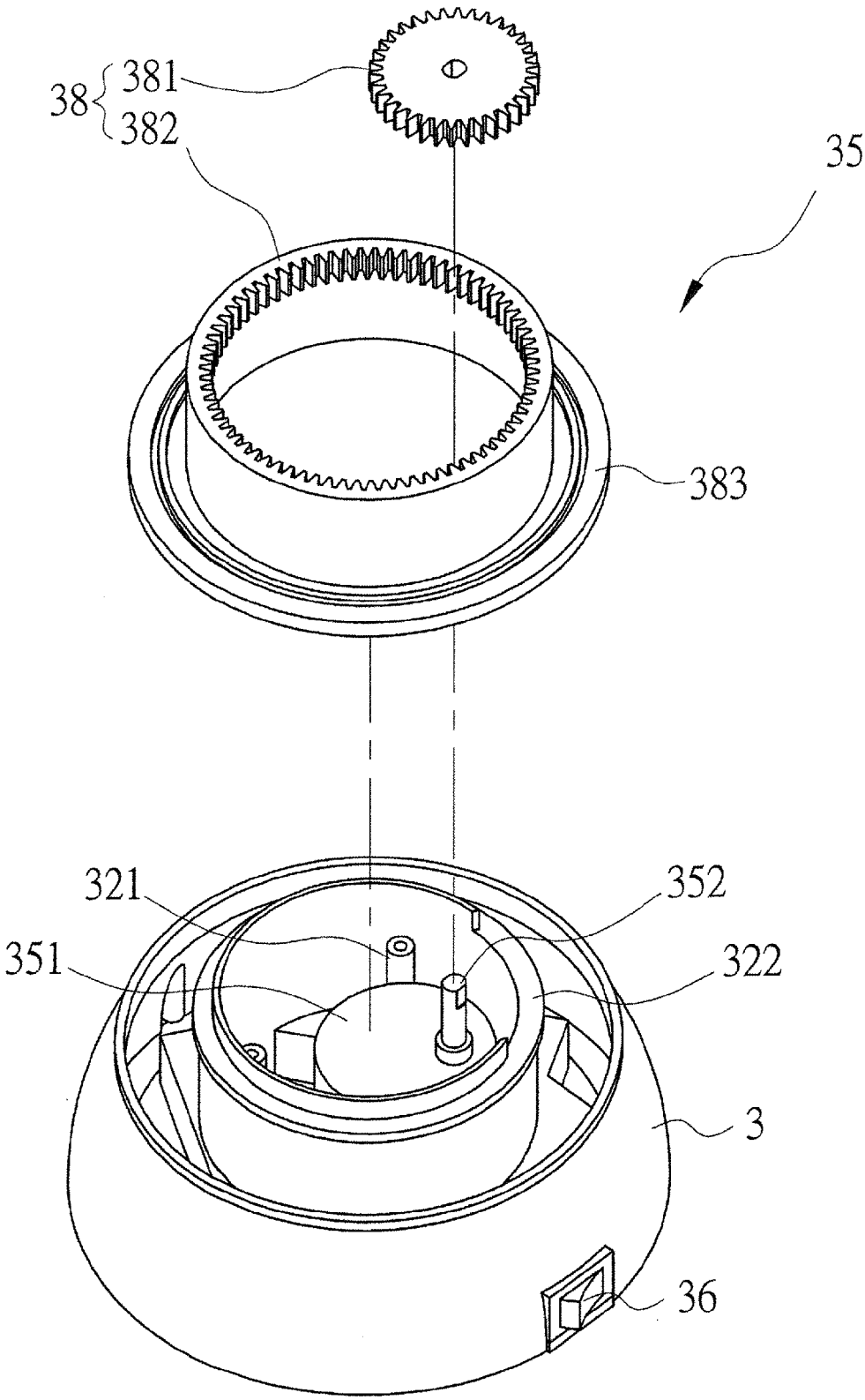
FIG. 3 is a disassembly diagram illustrating a stand of the preferred embodiment of the present invention.
Figure 4:
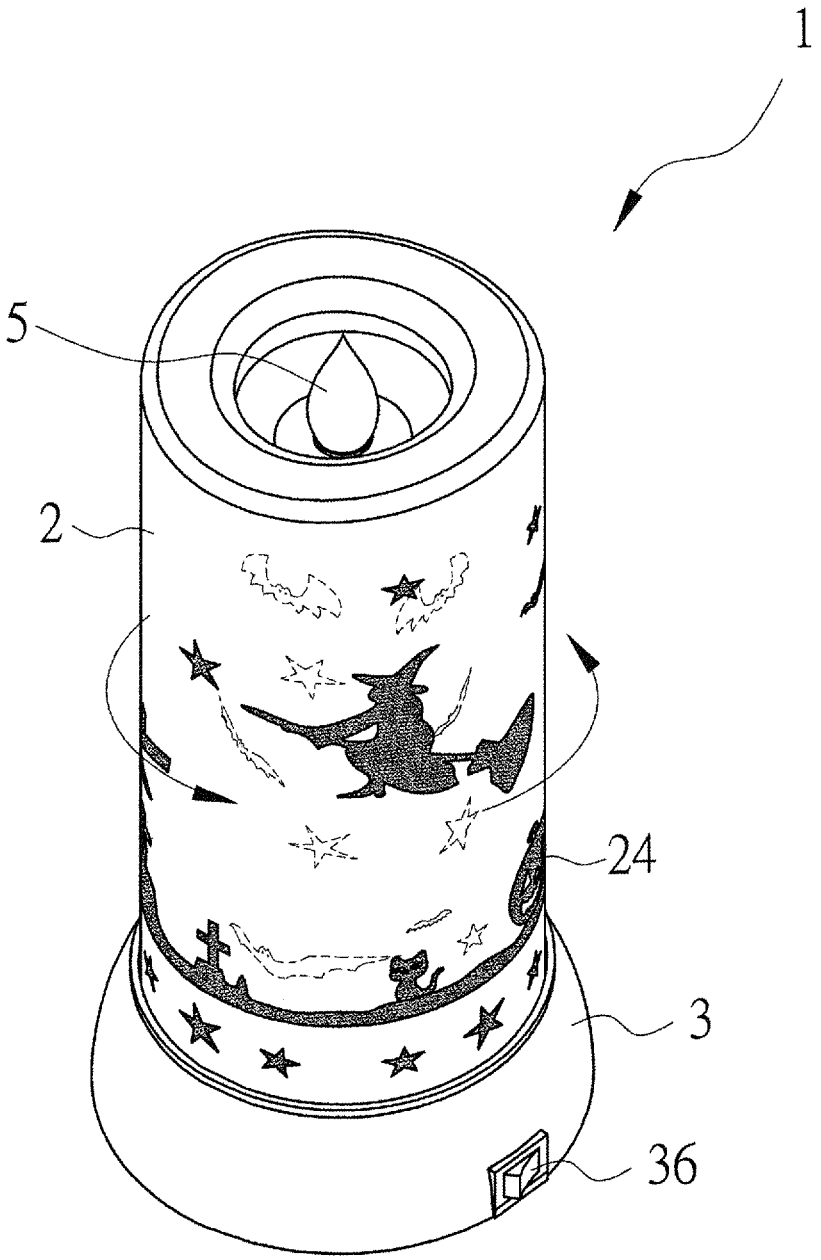
FIG. 4 is an assembly diagram n illustrating the preferred embodiment of the present invention.
Figure 5:
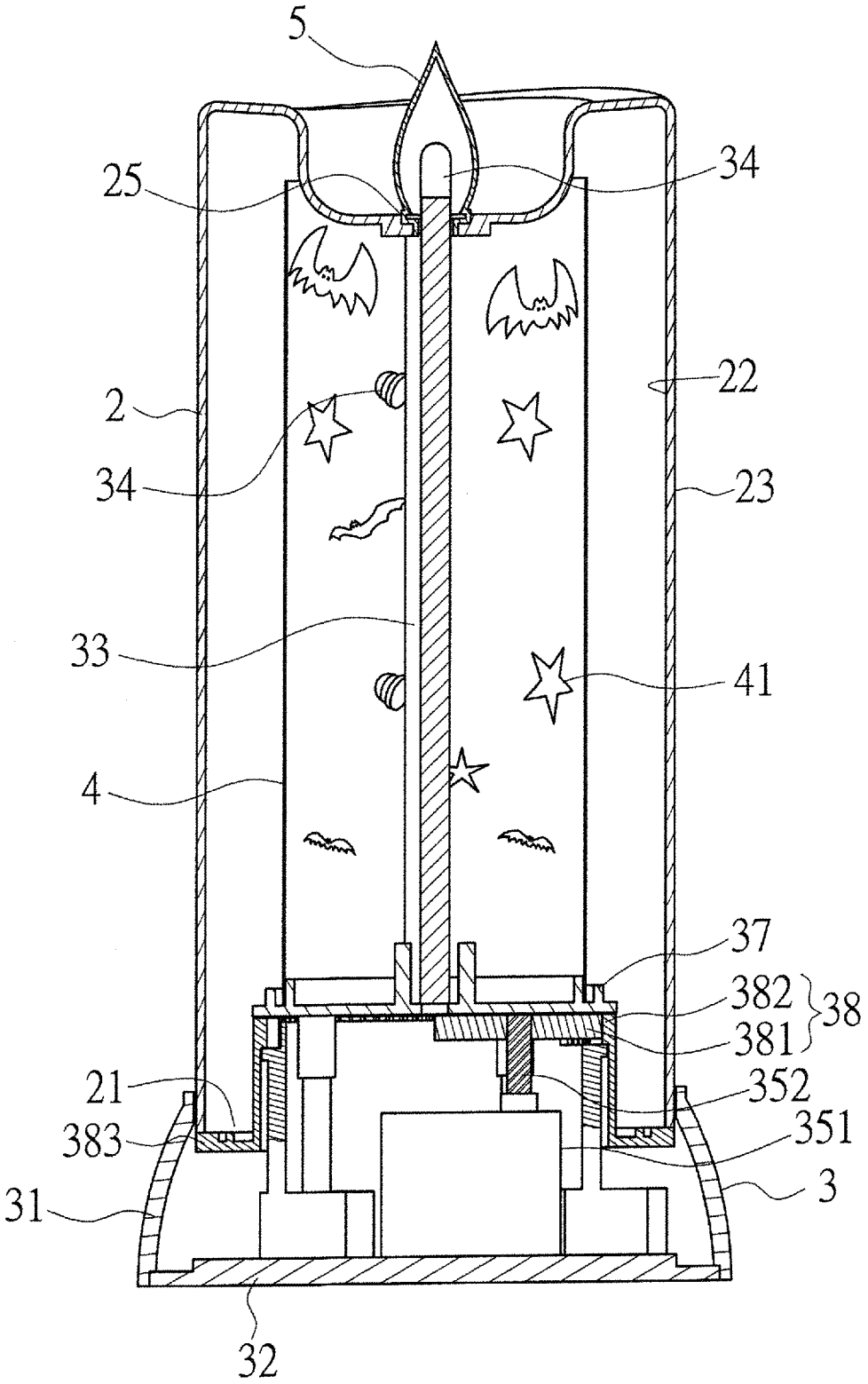
FIG. 5 is a cross-section diagram illustrating the preferred embodiment of the present invention.
Figure 6:
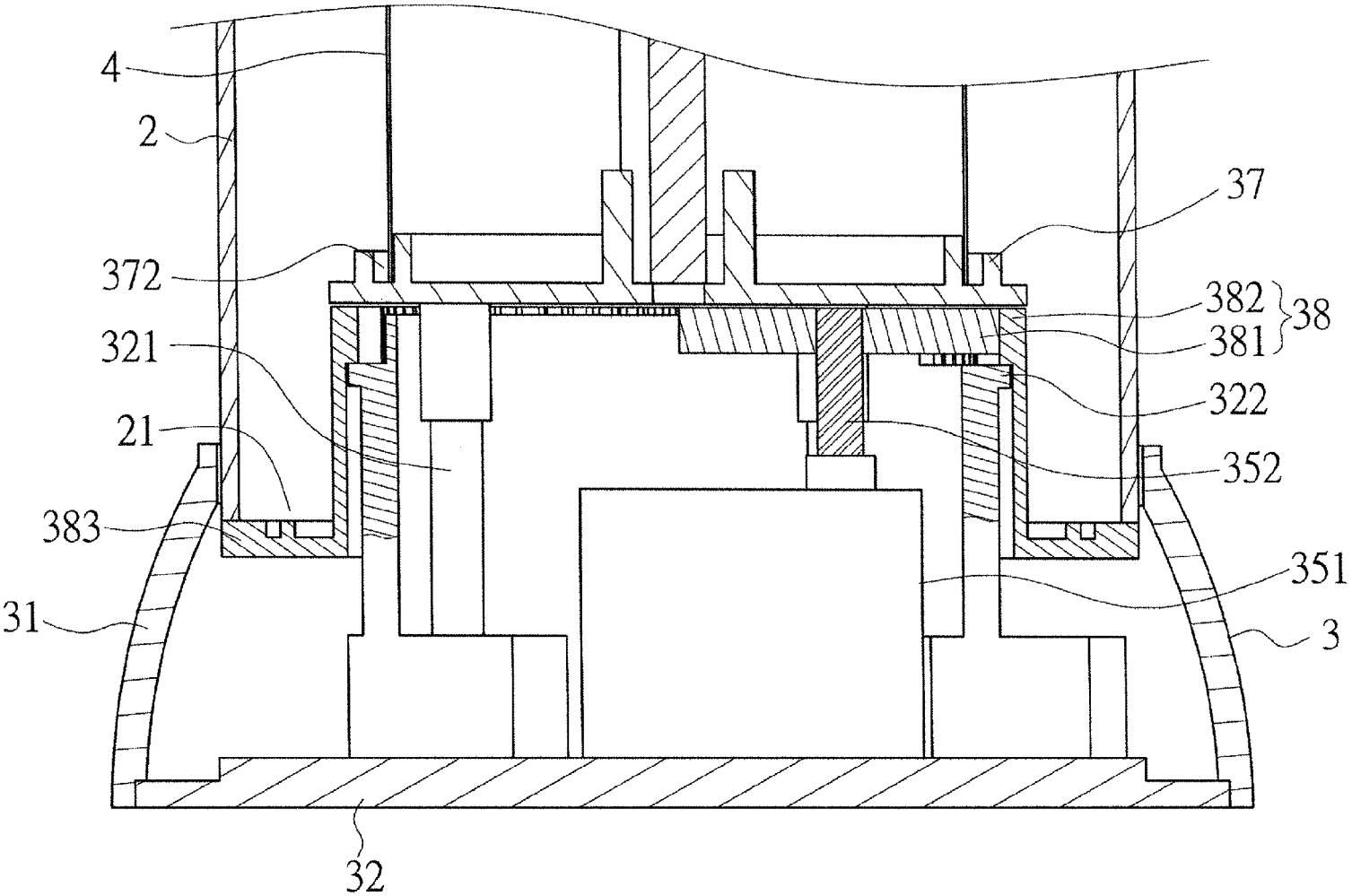
FIG. 6 is localized diagram illustrating an enlarged portion of FIG. 5.

Please refer FIG. 3. The rotating unit (35) consists of a power unit (351) and a gear set (38). In this preferred embodiment the power unit (351) is an electrical motor, which is surrounded by the bridge part (322). The power unit (351) can be connected to an electricity source like a battery pack, an alternate current or a direct current that the source of electricity is omitted hereinafter because of its broad variety and exclusion from the claims of the present invention.

The gear set (38) consists of a driving gear (381), which is configured with outward teeth, and a spinning gear (382), which is configured with inward teeth, that the driving gear (381) is connected with a shaft (352), which is extended out of the power unit (351), while the spinning gear (382) is positioned onto the bridge part (322) of the stand (3) and engaged with the driving gear (381). An outer circumference of the spinning gear (382) is further configured with a step (383) along the bridge part (322) that a bottom of the candle shell (2) is assembled to the step (383). The present invention does not limit the method for assembling the candle shell (2) so that assembly by adhesive, screw, embedding and so on are all within the scope of the present invention.

The reflector (4) is non-transparent and positioned inside the candle shell (2) so as to surround the multiply illuminators (34). A bottom of the reflector (4) is securely positioned into a groove (372) of the support element (37) and a portion of the reflector (4) is configured with a void area (41). The art for achieving the non-transparent reflector (4) can be adding dyne into the plastic injection molding or painting on one surface of a transparent plastic sheet such that the void area (41) can be either a void by material removal or a transparent area by painting removal.

According to the above-mentioned, the spinning gear (382) is positioned onto the bridge part (322) and driven by the driving gear (381) that a friction is constituted at the interface between the spinning gear (382) and the bridge part (322) during operation. A lubricant or grease can be applied between the spinning gear (382) and the bridge part (322) in order to improve the rotating motion.

Further, a clearance is kept between the bottom lid (32) of the stand (3) and the support element (37) after it is assembled into the stand (3) above the gear set (38) so as to constrain an axial movement of the spinning gear (382). After the assembly of the spinning gear (382), the step (383) of the spinning gear (382) is circularly positioned around the circumference of the bridge part (322) so as to constrain the radial movement of the spinning gear (382) and limit both the spinning gear (382) and the candle shell (2) above the stand (3).

Thereby, when the switch (36) is turned on to set the power unit (351) at a conductive state, the driving gear (381) will rotate with the shaft (352) and thus drive the spinning gear (382) into a rotating state. Then the light emitted from the illuminators (34) will transmit through the void area (41) of the reflector (4) so as to project the shape of the void area (41) on the candle shell (2), which is already at spinning state. The combined effect of spinning and light projection will achieve the dynamic visual effect of the present invention.

I claim:

1. A candle-like lighting device comprising;

a candle shell in a hollow and transparent form with a downward opening and a predetermined texture on an outer surface;

a stand positioned underneath said candle shell, said stand provided therein with a control circuit, at least an illuminator electrically connected with the control circuit and a rotating unit such that the illuminator is surrounded by said candle shell while the rotating unit comprises a gear set connected to a power unit and said candle shell positioned on the gear set for spinning as driven thereby;

a support element fixedly mounted to the stand and supporting the control circuit thereon; and a reflector in non-transparent form with a bottom securely positioned on and mounted to said support element and a top extended inside said candle shell for surrounding the illuminator that a portion of said reflector configured with a void area;

wherein said gear set comprises a spinning gear operatively coupled to and driven by said power unit, said stand comprising a bridge part circularly around the power unit to rotatably support said spinning gear thereon, said spinning gear comprising a step supporting said candle shell thereon; and wherein said support element is positioned above said gear set with the spinning gear partly interposed between said support element and the bridge part to constrain an axial movement of the spinning gear relative to the stand, and said step of the spinning gear being circularly positioned around a circumference of the bridge part to constrain a radial movement of the spinning gear relative to the stand.

2. The candle-like lighting device of claim 1 wherein the gear set includes a driving gear with outward teeth mating inward teeth of the spinning gear, and the driving gear is connected to the power unit.

3. The candle-like lighting device of claim 1 wherein further includes a bulb as positioned within an aperture configured at a top surface of said candle shell.

4. The candle-like lighting device of claim 3 wherein one of the illuminator as electrically connected to the control circuit is positioned inside the bulb.

5. The candle-like lighting device of claim 1 wherein the support element is configured with a groove to accommodate said reflector.

6. The candle-like lighting device of claim 1 wherein said stand is provided with a switch as electrically connected with the control circuit.

* * * * *